US008859867B2

(12) United States Patent
Tarohra

(10) Patent No.: US 8,859,867 B2
(45) Date of Patent: Oct. 14, 2014

(54) STRING TENSION SUPPORT STRUCTURE

(75) Inventor: Masami Tarohra, Nagano (JP)

(73) Assignee: Tokiwa Co., Ltd., Nagano (JP)

( * ) Notice: Subject to any disclaimer, the term of this patent is extended or adjusted under 35 U.S.C. 154(b) by 169 days.

(21) Appl. No.: 13/635,744

(22) PCT Filed: Mar. 23, 2012

(86) PCT No.: PCT/JP2012/002052

§ 371 (c)(1),
(2), (4) Date: Sep. 18, 2012

(87) PCT Pub. No.: WO2013/140466

PCT Pub. Date: Sep. 26, 2013

(65) Prior Publication Data

US 2013/0247742 A1 Sep. 26, 2013

(51) Int. Cl.
*G10D 3/04* (2006.01)

(52) U.S. Cl.
CPC ..... *G10D 3/04* (2013.01)
USPC ..... 84/298

(58) Field of Classification Search
CPC ..... G10D 3/04
USPC ..... 82/298, 291–293, 173; D17/14
See application file for complete search history.

(56) References Cited

U.S. PATENT DOCUMENTS 4,846,038 A * 7/1989 Turner ..... 84/293
5,072,643 A * 12/1991 Murata ..... 84/293

FOREIGN PATENT DOCUMENTS

| | | | |
|---|---|---|---|
| JP | S63-191387 | U | 12/1988 |
| JP | H02-73295 | A | 3/1990 |
| JP | H02-73691 | U | 6/1990 |
| JP | H07-34483 | U | 6/1995 |
| JP | H11-338463 | A | 12/1999 |
| JP | 2001-13957 | A | 1/2001 |

OTHER PUBLICATIONS

International Search Report of PCT/JP2012/002052, Apr. 24, 2012.

* cited by examiner

*Primary Examiner* — Jianchun Qin

(57) ABSTRACT

A neck (3) of an electric guitar (1) comprises a first wooden neck member (31), and a second metal neck member (33). The second neck member (33) is disposed in a state in which strings (10) span from the nut (5) of the neck (3) to a bridge (8) of a body (2), and is partially secured in a plurality of locations to the first neck member (31) and the body (2). The strings (10) are in a state of tension between two ends of the second neck member (33), and good sound quality can be maintained because string vibrations are transmitted to the pickup side with good efficiency via the first neck member (31). Since the neck body portion (3A) protruding from the body (2) is reinforced by the second neck member (33), the incidence of warping or other forms of deformation in the neck body portion (3A) can be prevented.

5 Claims, 4 Drawing Sheets

(a)

(b)

STRING TENSION SUPPORT STRUCTURE

TECHNICAL FIELD

The present invention relates to a string tension support structure (string tension bridge) that can transmit string vibrations with good efficiency and keep sound quality in a good state, and that can prevent or suppress neck warping or other deformation in an electric guitar and an electric bass.

BACKGROUND ART

Electric guitars and electric basses generally have a long, narrow, wooden neck secured to a wooden body, and are configured with a plurality of strings stretched between a bridge secured to the body surface and a nut secured to the distal end of the neck. Warping referred to as "forward warp" in which the fingerboard side becomes concave, warping referred to as "reverse warp" in which the fingerboard side becomes convex, twisting, and other deformations occur in the neck due to changes in string tension, environmental temperature and humidity, and other factors. Conventionally, a neck reinforcement member is attached to the neck to increase the rigidity of the neck and prevent warping and other deformation of the neck.

In the correction device disclosed in Patent Document 1 (Japanese Laid-open Utility Model Application No. 7-34483), a reinforcement member referred to as an adjusting rod is mounted on the neck, and the tension of the adjusting rod is adjusted to prevent or correct warping of the neck.

In the neck warping prevention structure disclosed in Patent Document 2 (Japanese Laid-open Utility Model Application No. 63-191387), a long, narrow plate-shaped metal reinforcement member is mounted on the neck, whereby neck warping is prevented. In the neck warping prevention structure disclosed in Patent Document 3 (Japanese Laid-open Patent Application No. 2001-13957), a reinforcement member made of sheet metal is embedded in the neck, whereby rigidity and strength are increased and warping and other deformation of the neck are prevented.

In the stringed instrument disclosed in Patent Document 4 (Japanese Laid-open Patent Application No. 02-73295), a cast structural member for reinforcement is embedded in the neck and body, which are molded from a resin, whereby the rigidity and strength of the neck and body are increased; and frets are integrally formed with the cast structural member, whereby the work for attaching the frets is simplified.

PRIOR ART DOCUMENTS

Patent Documents

[Patent Document 1] Japanese Laid-open Utility Model Application No. 7-34483

[Patent Document 2] Japanese Laid-open Utility Model Application No. 63-191387

[Patent Document 3] Japanese Laid-open Patent Application No. 2001-13957

[Patent Document 4] Japanese Laid-open Patent Application No. 2-73295

DISCLOSURE OF THE INVENTION

Problems to be Solved by the Invention

In a conventional neck structure, the strength and rigidity of the neck are increased by incorporating a metal plate or another reinforcement member into the neck. However, no attempt has been made to improve the neck structure for the purpose of transmitting string vibrations with good efficiency to a microphone (pickup) on the body side, and no proposal has been made in relation to a neck structure for achieving this purpose.

For example, in the neck reinforcement structure disclosed in Patent Documents 2 and 3, the rigidity of the neck has been increased, and therefore the required flexibility (bending) in the neck when a string is played is lost, the string vibration produces a metallic sound, and string vibrations having good sound quality cannot be efficiently transmitted to the microphone attached to the body. Accordingly, neck reinforcement structures in which a metal plate has been embedded in the neck to increase the rigidity of the neck and prevent warping and other deformations have mostly not been implemented at the current time.

The stringed instrument achieves very high rigidity overall in the case of a structure in which the neck and body are molded as a resin article, and a cast structural member is embedded so as to be integrated throughout the entire neck and body, as disclosed in Patent Document 4. However, in the case that this configuration is applied to an electric guitar comprising a neck and body made of wood, flexibility (bending) in the neck that accompanies string vibration is inhibited, string vibrations are not transmitted with good efficiency, and an electric guitar having good sound quality cannot be obtained.

In view of the foregoing points, an object of the present invention is to provide a string tension support structure (a string tension bridge) for an electric guitar and electric bass that can transmit string vibrations with good efficiency so the sound will not have a metallic quality, and that can keep the neck in an optimum forward warped state to improve playability.

Means to Solve the Above-Mentioned Problems

In order to solve the problems described above, according to the present invention, there is provided a string tension support structure of an electric guitar or an electric bass comprising a body, a neck, and a plurality of strings spanning from a nut attached to the distal end part of the neck to a bridge attached to the surface of the body in a state of tension, string tension support structure characterized that the neck is provided with a first wooden neck member secured to the body, a fingerboard attached to the surface of the first neck member, and a second metal neck member partially secured in a plurality of locations to both the first neck member and the body;

the second neck member is provided with a distal-end-side portion disposed inside the first neck member, and a rear-end-side portion disposed inside the body;

the distal end of the distal-end-side portion extends to the disposed positions of the nut at the distal end part of the neck in the neck lengthwise direction; and the rear end of the rear-end-side portion extends at least to the positions at which the strings are secured to the body in the neck lengthwise direction.

In the electric guitar or electric bass of the present invention, the second metal neck member is disposed from the position of the nut of the neck distal end part to the secured position on the body side, spanned by the tensioned strings. In other words, the second metal neck member is disposed over a range of the strings during vibration that includes the joints on both sides. Therefore, the tension of the string is borne by the second neck member, and the incidence of warping or other deformation is inhibited by the neck body portion.

The second metal neck member is merely partially secured in a plurality of locations to the both the first neck member and the body, and the flexibility (bending) of the first neck member and body required for transmitting string vibrations is therefore ensured. Accordingly, string vibrations can be transmitted with good efficiency to the pickup side via the first neck member and the body made of wood. The sound does not assume a metallic quality, and a state of good sound quality is maintained. Furthermore, since the second metal neck member extends from the position of the nut to the body-side securing position, string vibrations are transmitted with good efficiency via the second neck member as well.

Thus, resonance is liable to be generated in the second neck member in accompaniment with string vibration because the second neck member, which is a neck constituent element, functions as a transmission member for transmitting string vibrations. In order to avoid resonance in the second neck member, it is effective to dispose a plurality of securing positions at a different pitch in the neck lengthwise direction, with the securing positions being used for securing the second neck member to the first neck member and the body.

The second neck member can be a planar member comprising: a plurality of longitudinal ribs extending in the neck lengthwise direction; a plurality of lateral ribs extending in the neck width direction perpendicular to the neck lengthwise direction; or a plurality of diagonal ribs extending in a direction different from the longitudinal ribs and the lateral ribs. In this case, the longitudinal ribs, the lateral ribs, and the diagonal ribs are preferably disposed in a bilaterally symmetric manner with respect to the neck width direction so that twisting and other deformations are not generated in the neck. It is effect for the opening parts surrounded by the longitudinal ribs, the lateral ribs, and the diagonal ribs to have mutually different shapes in the neck lengthwise direction so that the second neck member does not resonate in accompaniment with string vibrations.

Next, predetermined flexing (bending) must be generated in accompaniment with string vibrations in order to maintain good sound quality, and at times the rigidity of the neck composed of the first neck member and the second neck member cannot be increased to a level at which warping and other deformations do not occur in the neck. In such cases, a rod-shaped neck reinforcement member is preferably disposed inside the neck body portion in order to inhibit or correct deformation occurring in the neck body portion of the neck, the neck body portion protruding from the body. The neck reinforcement member can be caused to span, in a tensioned state, the distal end part to the rear end part in the neck lengthwise direction of the neck body portion, whereby the overall neck body portion is made to uniformly bend by the tensile force of the neck reinforcement member, and the neck can be kept in a suitable forward warping state.

Also, in the case that a neck reinforcement member is disposed, it is possible to form a groove extending in the neck lengthwise direction in the distal-end-side portion of the second neck member along the center position of the neck width direction in the distal-end-side portion, mount the neck reinforcement member in this location, and cause the neck reinforcement member to span, in a tensioned state, the distal end part to the rear end part in the distal-end-side portion of the second neck member.

MODE FOR CARRYING OUT THE INVENTION

Figure 1:
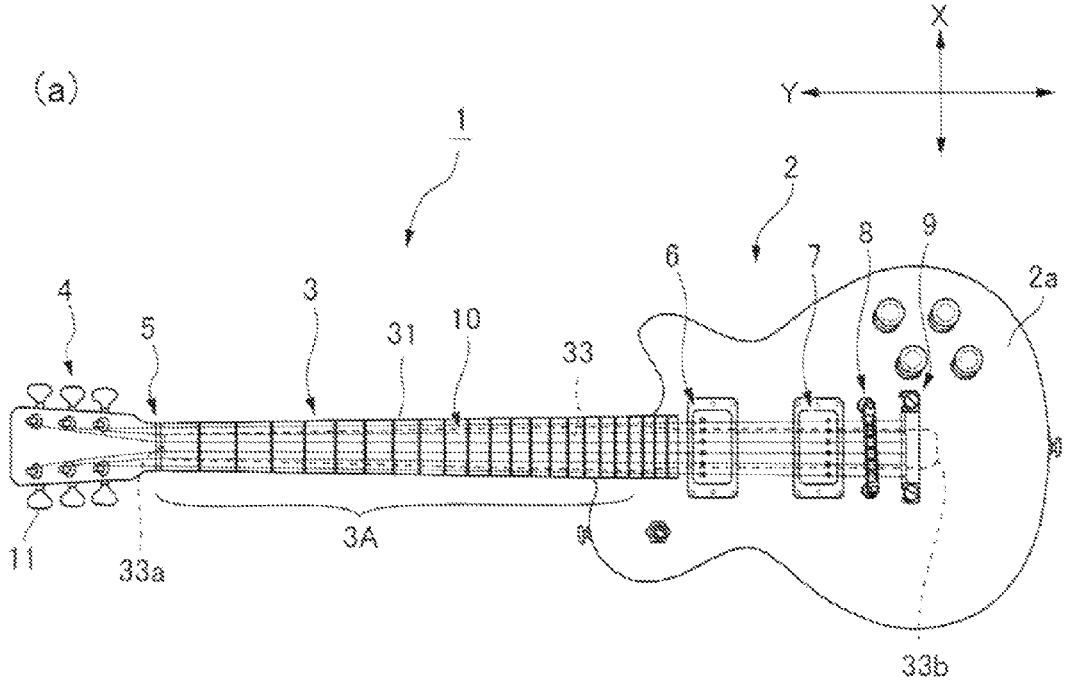
FIG. 1(*a*) is a schematic plan view showing an example of an electric guitar to which the present invention has been applied, and FIG. 1(*b*) is a schematic plan view showing a modification thereof.
Figure 1:
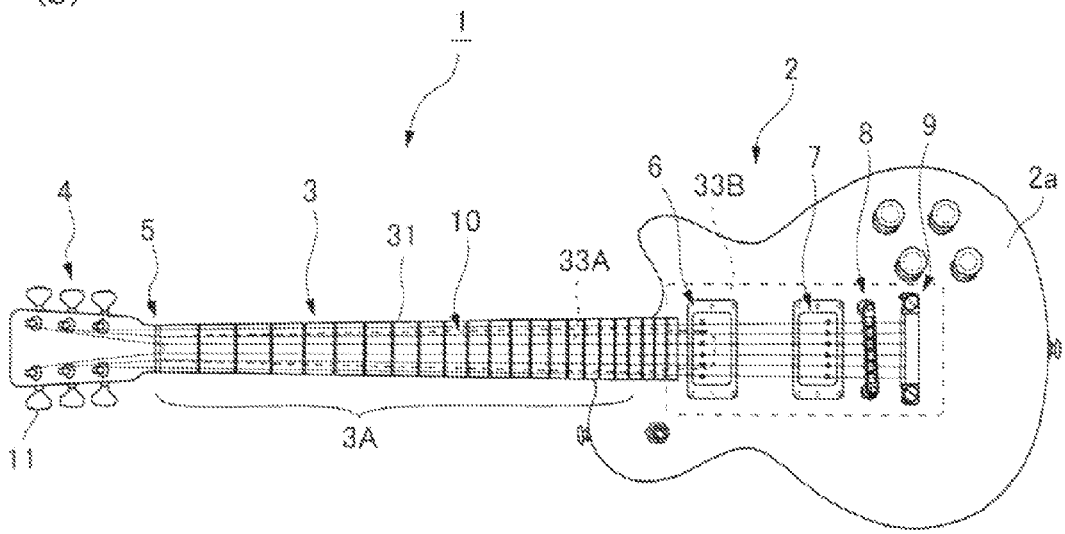

An embodiment of the present invention is described below with reference to the drawings. There follows a description of a case where the present invention has been applied to an electric guitar, but it is apparent the present invention can also be similarly applied to an electric bass. The electric guitar 1 according to the embodiment of the present invention is, e.g., a Les Paul-type guitar, and is provided with a body 2 made of wood, a neck 3 composed of a composite member, and a head 4 that is bent and extended from the distal of the neck 3 to the reverse side, as shown in FIG. 1(*a*) and FIG. 2(*a*). Also, the neck 3 of the present example is a through-neck, and the rear-end-side portion of the neck 3 extends to a position on the rear side of the tailpiece attachment position of the body 2.

A nut 5 for transmitting string vibrations is attached to the distal end of the obverse surface of the neck 3; and a pickup 6, a pickup 7, a bridge 8, and a tailpiece 9 are attached, from the neck 3 side, to the obverse surface 2*a* of the body 2 along the neck lengthwise direction Y. Generally, six strings 10 are caused to span, in a tensioned state, the nut 5 to the bridge 8 (alternatively, seven or more strings 10 may be disposed). The distal end portions of the strings 10 are wound onto pegs 11 attached to the head 4, and the rear end portions of the strings 10 are latched to the tailpiece 9 side.

Figure 3:
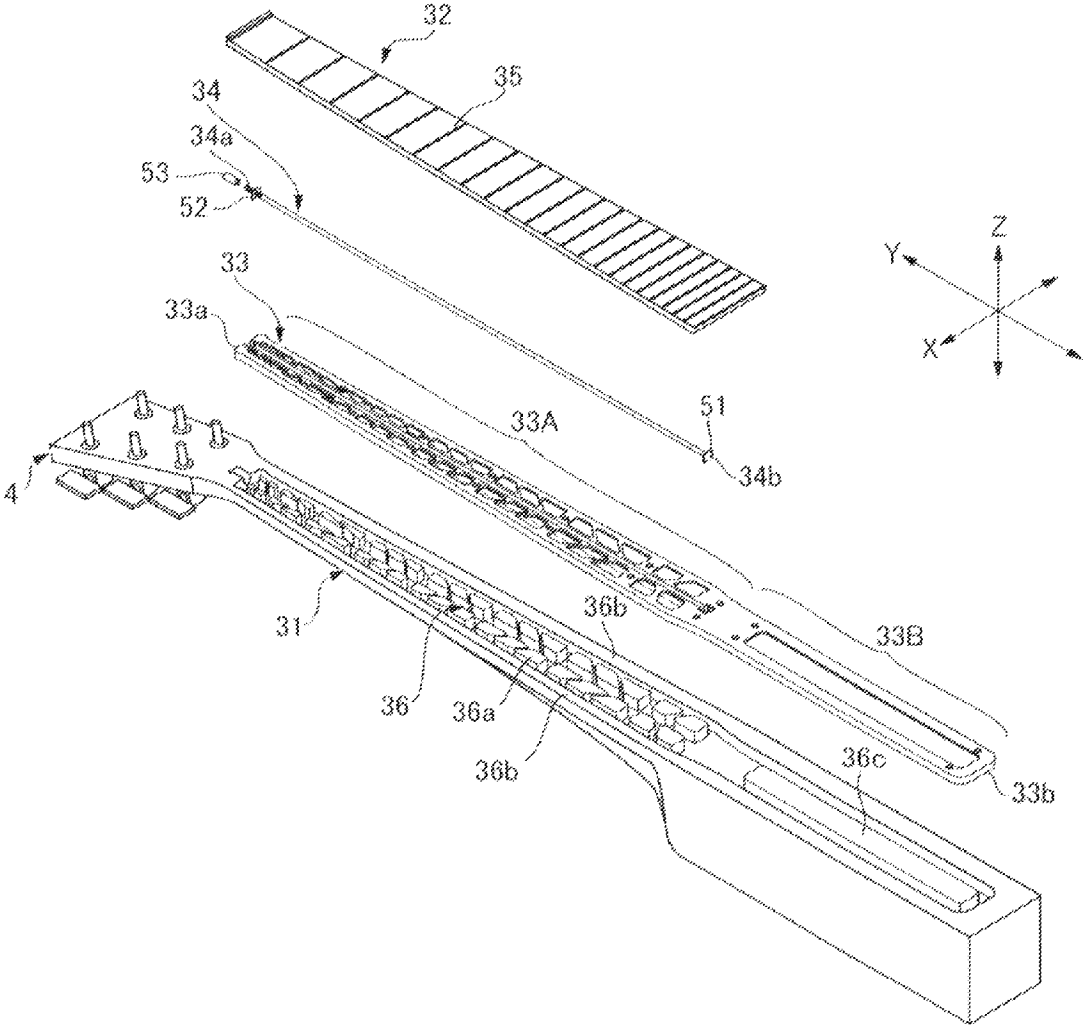
FIG. 3 is an exploded perspective view of the main components in the electric guitar of FIG. 1.

FIG. 3 is an exploded perspective view of the main components primarily showing the structure of the neck 3 of the electric guitar 1. The neck 3 comprises: a long, narrow, rectilinear first wooden neck member 31 secured to the body 2 in a state extending in the neck lengthwise direction Y; a fingerboard 32 affixed to the obverse surface of the portion protruding from the body 2 in the first neck member 31; a second neck member 33 composed of a planar frame secured in a plurality of locations to the first neck member 31 and the body 2; and a metal adjusting rod 34 for reinforcing the neck attached to the second neck member 33. A head 4 is integrally formed at the distal end of the first neck member 31, and a plurality of frets 35 are attached at predetermined intervals on the obverse surface of the fingerboard 32.

The second neck member 33 comprises a distal-end-side portion 33A disposed inside the portion protruding from the body 2 in the first neck member 31, and a rear-end-side portion 33B disposed inside the body 2 (inside the portion on the body 2 side of the first neck member 31). The distal end 33*a* of the distal-end-side portion 33A extends to the disposed position of the nut 5 in the neck lengthwise direction Y. The rear end 33*b* of the rear-end-side portion 33B extends to the disposed position of the tailpiece 9 in the neck lengthwise direction Y (the position where the strings 10 are secured to the body 2).

Figure 2:
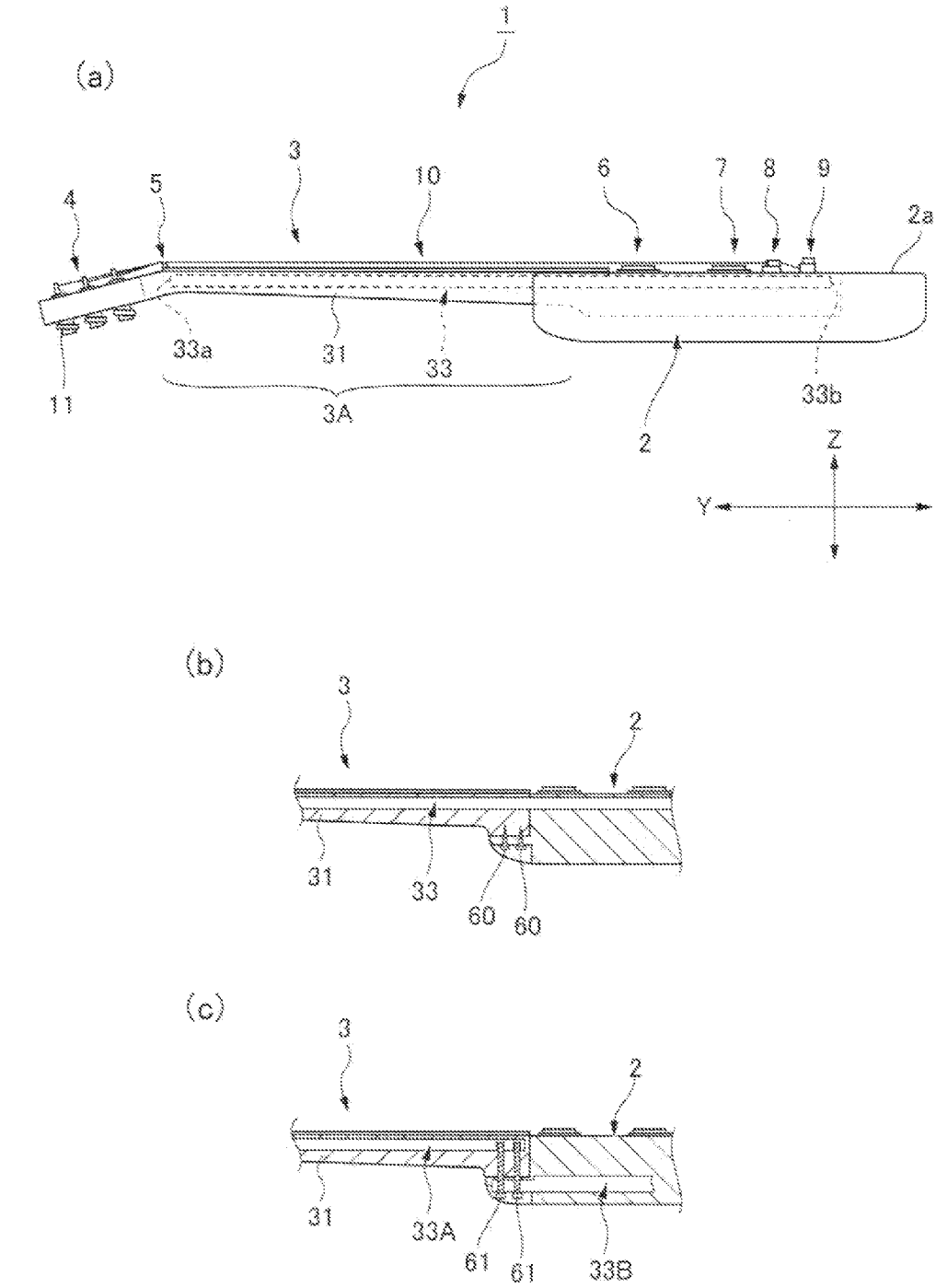
FIG. 2(*a*) is a schematic side view of the electric guitar of FIG. 1, FIG. 2(*b*) is a schematic view showing an example of the joint section of the neck and body, and FIG. 2(*c*) is a schematic view showing another example of the joint section of the neck and body.

The neck 3 can also be screwed to the body 2 in a detachable joining scheme, as schematically shown in FIG. 2(*b*). In this case, the first neck member 31 is connected and secured by a plurality of wood screws 60 threaded into the body 2 in the body thickness direction. The neck 3 can also held to the body 2 by adhesive in a set-neck joining scheme.

It is also possible to use a bolt-on structure as the detachable joining scheme. In this case, the second neck member 33 is formed from two members: the distal-end-side portion 33A and the rear-end-side portion 33B; and is connected and secured by a plurality of bolts 61 fastened in the body thickness direction between the rear end portion of the distal-end-side portion 33A disposed inside the first neck member 31 and the distal end portion of the rear-end-side portion 33B disposed inside the body 2, as shown in FIG. 2(*c*). The first neck member 31 is also fastened and secured to the body 2 by the bolts, and the fastening strength therebetween can be considerably increased. In this case, as shown in FIG. 1(*b*), the rear-end-side portion 33B on the body side is preferably wider than the distal-end-side portion 33A and wide enough to include the bridge 8 and the tailpiece 9. The bridge 8 and the tailpiece 9 can thus also be secured to the rear-end-side portion 33B.

Figure 4:
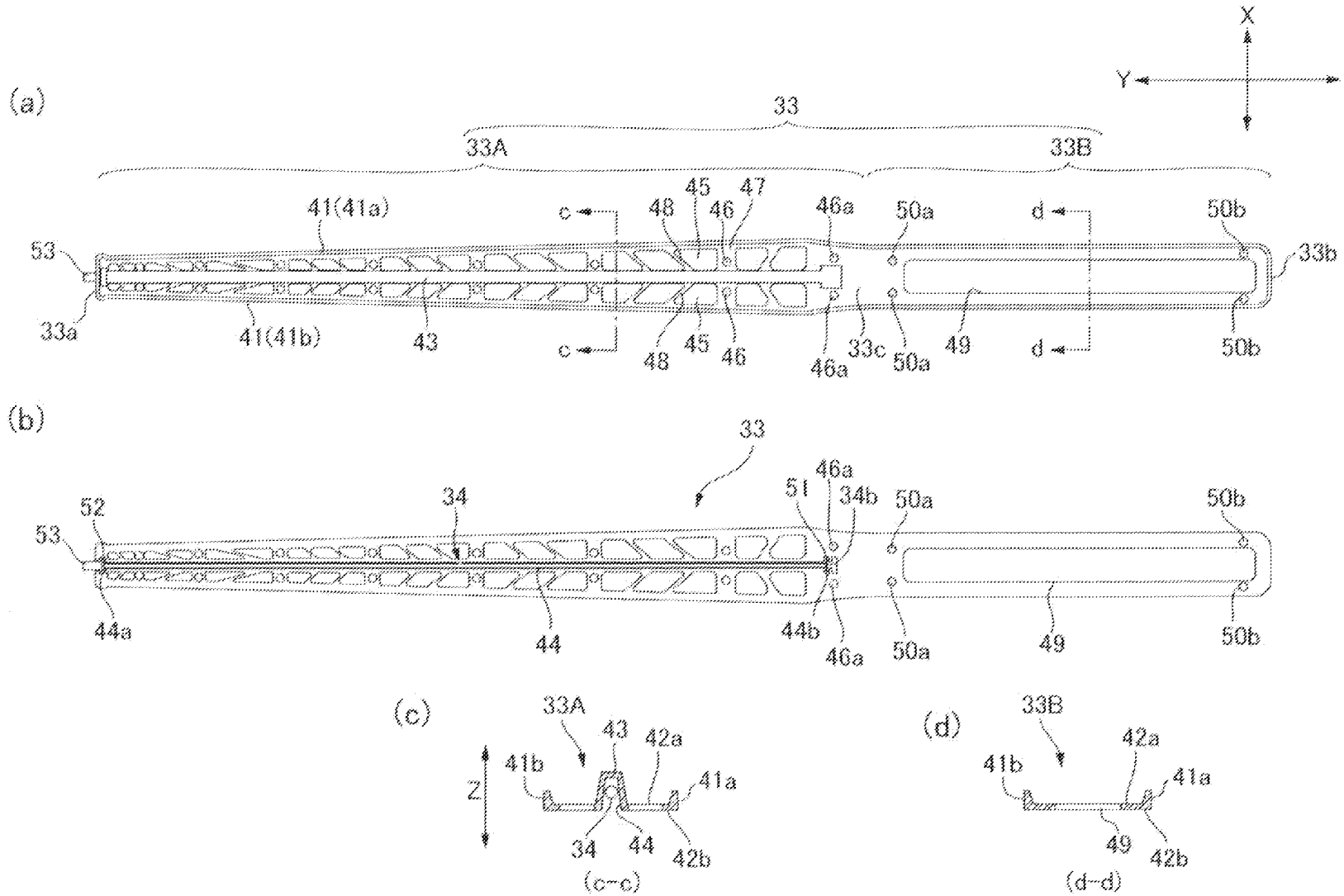
FIG. 4(*a*) is a reverse surface view showing the second neck member and the adjusting rod, which are neck constituent components, FIG. 4(*b*) is a planar view thereof, FIG. 4(*c*) is a cross-sectional view of the portion sectioned along the line c-c of FIG. 4(*a*), and FIG. 4(*d*) is a cross-sectional view of the portion sectioned along the line d-d of FIG. 4(*a*).

FIG. 4(*a*) is a reverse surface view showing the second neck member 33 and the adjusting rod 34 constituting the neck, FIG. 4(*b*) is an obverse surface view thereof, FIG. 4(*c*) is a cross-sectional view of the portion sectioned along line c-c of FIG. 4(*a*), and FIG. 4(*d*) is a cross-sectional view of the portion sectioned along line d-d of FIG. 4(*a*).

With reference primarily to FIG. 4, the second neck member 33 is a plate-shaped frame obtained by cutting a long, narrow aluminum rod having a set thickness, e.g., 10 mm, and has a symmetrical shape with respect to the center of the neck width direction X. The distal-end-side portion 33A of the second neck member 33 has an overall shape profile in which the width gradually decreases from the portion on the rear end side toward the distal end. The rear-end-side portion 33B has an overall shape profile in which the width is substantially fixed. The second neck member 33 receives a force for shortening the neck 3 in the neck lengthwise direction Y of the neck member.

The second neck member 33 has an external peripheral rib 41 with a fixed width formed at the external peripheral edge of the plate-shaped portion having a thickness of about 3 mm; and the external peripheral rib 41 has a tapered trapezoidal cross section and protrudes at a right angle from the reverse surface 42*b* of the second neck member 33 to the obverse surface 42*a* side. Also, a center longitudinal rib 43, which has a substantially rectangular cross section extending in rectilinear fashion in the neck lengthwise direction Y and protruding to the obverse surface 42*a* side, is formed in the distal-end-side portion 33A in the center portion of the neck width direction X. The center longitudinal rib 43 extends from a position in the vicinity of the distal end 33*a* of the distal-end-side portion 33A to the position in the vicinity of the rear end 33*c* of the distal-end-side portion 33A. A rod-mounting groove 44 that extends in rectilinear fashion in the neck lengthwise direction Y and that has a rectangular cross section open on the reverse surface 42*b* side is formed by the center longitudinal rib 43.

Here, the height of the center longitudinal rib 43 is, e.g., 10 mm (the height in the neck thickness direction Z, and the height of the external peripheral rib 41 is different from the center longitudinal rib 43, and is low, e.g., 5 mm. Such a configuration makes it possible to prevent resonance in the fret positions and to separate the high sound range and low sound range. Resonance occurs when the vibrations of the first wooden neck member 31 and the second metal neck member 33 overlap each other, and the vibrations in a particular sound range are amplified. The occurrence of resonance is a critical problem in an instrument and must be reliably prevented.

Next, numerous openings 45 and securing circular screw holes 46 are formed in the distal-end-side portion 33A, between the center longitudinal rib 43 and the external peripheral longitudinal rib portions 41*a*, 41*b* that extend in the neck lengthwise direction in the external peripheral rib 41. The openings 45 and the screw holes 46 are formed in a symmetrical shape in the neck width direction X. More specifically, the openings 45 are formed between a plurality of plate-shaped lateral ribs 47 extending in the neck width direction X between the center longitudinal rib 43 and the external peripheral longitudinal rib portions 41*a*, 41*b* on the left and right, and a plurality of plate-shaped diagonal ribs 48 extending in the diagonal direction, which is diagonal to the neck lengthwise direction Y and the neck width direction X. Twisting of the neck 3 is prevented or inhibited by these lateral ribs 47 and diagonal ribs 48.

The lateral ribs 47 are formed in the neck lengthwise direction Y so that the intervals gradually narrow from the rear end 33*c* toward the distal end 33*a* of the distal-end-side portion 33A. Therefore, the interval of the diagonal ribs 48 disposed between the lateral ribs 47 gradually narrows toward the distal end 33*a* in the neck lengthwise direction Y. The openings 45 thereby differ from each other in size in the neck lengthwise direction Y. Also, pairs of screw holes 46 are formed in symmetrical positions, in positions in the vicinity of the lateral ribs 47 and the rear end 33*c*. The pitch of these screw holes 46 (securing positions) in the neck lengthwise direction Y is mutually different. Resonance is thereby prevented when an open string is played.

In contrast, the opening part 49 having a fixed width is formed along the entire rear-end-side portion 33B. Also, pairs of screw holes 50*a*, 50*b* (securing positions) are formed in symmetric positions in the rear end portion and in locations on the front side of the openings 49. In the case of the bolt-on structure shown in FIG. 2(*c*), the neck 3 and the body 2 are connected and secured in four locations by bolts that fasten together symmetrical pairs of screw holes 46*a* positioned in the rearmost end of the distal-end-side portion 33A, and symmetrical pairs of screw holes 50*a* positioned in the distal end side of the rear-end-side portion 33B.

A mounting groove 36 for mounting the second neck member 33 having the above-described shape is formed in the obverse surface of the first neck member 31, as is apparent in FIG. 3. The mounting groove 36 is a groove of complementary shape and depth relative to the first neck member 31. Protrusions 36*a*, 36*c* having a shape profile that corresponds to the openings 45 and openings 49 of the second neck member 33 are formed from the bottom surface of the mounting groove 36. The second neck member 33 is flush with the first neck member 31 in the state of being mounted in the mounting groove 36, and the protrusions 36*a*, 36*c* pass through the openings 45, 49 and are in a state of being exposed on the obverse surface 42*a* side. Securing screws (not shown) passed through the screw holes 46, 46*a*, 50*a*, 50*b* are threadably secured to the first neck member 31 and the body 2, whereby the second neck member 33 mounted in the mounting groove 36 is secured to the first neck member and the body. The fingerboard 32 is affixed in a state that conceals the first neck member and the body to the surface of the protrusions 36*a* and the surface 36*b* of the edge portion of the two sides of the mounting groove 36 in the first neck member 31. Thus, since the fingerboard 32 and the first wooden neck member 31 are affixed in state of direct contact, the fingerboard 32 and the first neck member 31 are reliably integrated, and string vibrations are transmitted with good efficiency via these components.

Described next with reference to FIGS. 3 and 4 is the structure of the mounting portion of the adjusting rod 34 for inhibiting or correcting deformations generated in the neck body portion 3A of the neck 3, the neck body portion protruding from the body 2.

As described above, the rod-mounting groove 44 is formed in the second neck member 33, and the adjusting rod 34 is mounted therein. A latch plate 51 having a rectangular profile is secured to the end part in the neck lengthwise direction Y of the adjusting rod 34, which is the rear-side end part 34*b* in the present example. A wide latch groove 44*b* is formed at the rear-end side of the rod-mounting groove 44, and the latch plate 51 is mounted therein, whereby the rear end of the adjusting rod 34 is latched to the second neck member 33 from the rear side in the neck lengthwise direction Y.

An external threading is cut into the end part 34*a* at the distal end side of the adjusting rod 34, a latch plate 52 having a rectangular profile is fitted thereon, and a nut 53 can be threadably secured. A wide latch groove 44*a* is formed at the end of the front side of the rod-mounting groove 44, and the latch plate 52 is mounted thereon. The mounting part (not shown) of the nut 53 is formed on the head 4 location of the neck 3.

When the nut 53 is threadably inserted, the adjusting rod 34 is drawn in the neck lengthwise direction Y, and a tensile force generated thereby acts between the rear end 33*c* and the distal end 33*a* of the distal-end-side portion 33A in the second neck member 33. This tensile force causes the entire second neck member 33 to uniformly flex to the fingerboard 32 side in the neck lengthwise direction Y. As a result, a required suitable string height is obtained in the position of the twelfth fret (the lift from the fret surface is 0.15 mm). Forward warping and other deformation of the neck body portion 3A in the neck 3 that is protruding from the body 2 can be prevented or inhibited, and adjustment for obtaining a suitable string height in each fret position in the neck lengthwise direction Y can be performed in a simple manner.

In the electric guitar 1 according to the present embodiment configured in the manner described above, the neck 3 is composed of a first wooden neck member 31 and a second metal neck member 33. The second neck member 33 is disposed between the joints at the two ends of the strings 10 which are held under tension. Therefore, string vibrations are transmitted with good efficiency to the pickups 6, 7 via the body 2 and first wooden neck member 31 and positioned between the joints at the two ends. Accordingly, the second metal neck member 33 for reinforcing the neck 3 is disposed to thereby increase the neck rigidity. String vibrations can be transmitted even when the flexing performance of the neck 3 is slightly reduced, and a reduction in sound quality due to a more highly rigid neck 3 can be prevented or inhibited.

The strength and rigidity of the second neck member 33, and the securing force to the first neck member 31 and the body 2 are suitably set, whereby the string vibrations can be transmitted with good efficiency to the pickups 6, 7 and the sound quality can be improved. In addition to the above, the pitch of the securing positions (the positions of the screw holes 46, 50*a*) for securing the second neck member 33 to the first neck member 31 and the body 2 is made to differ in the neck lengthwise direction Y. Since the securing positions of the second neck member 33 function as joints during vibration, the pitch of the securing positions is set so as to be mutually different in the neck lengthwise direction Y, whereby the second neck member 33 can be reliably prevented from generating resonance in response to string vibrations.

The openings 45 having mutually different shape profiles in the neck lengthwise direction Y are formed in the second neck member 33. This also makes it possible for the second neck member 33 to be reliably prevented from generating resonance in response to string vibrations.

Warping, twisting, and other deformation of the neck 3 can be prevented or inhibited because the strength and rigidity of the neck 3 is increased by the second neck member 33 attached to the neck 3. Tensile force is imparted to the neck body portion 3A protruding from the body 2 using the adjusting rod 34 or another neck reinforcement member, making it possible to reliably prevent both forward warping, in which the neck body portion 3A warps in a concave shape to the reverse surface side, and reverse warping, in which the neck body portion warps in a concave shape to the obverse surface side, due to the tensile force of the strings 10 or another factor.

In this manner, the generation of warping and other deformations of the neck 3 can be prevented by the second neck member 33, which is a metal reinforcement member, and warping of the neck 3 can be corrected to the correct position (the position in which playing performance is not affected and forward warping uniformly occurs due to the tensile force of the strings). Thus, the weak point of the wood material can be offset and the sound of the wood material produced by string vibration can be efficiently transmitted to the body 2. The second neck member 33 is formed in a rib shape, and can thereby be made more lightweight than a conventional structure for preventing neck warping. As a result, an electric guitar and an electric bass having improved playability can be achieved.

In the present embodiment, the second neck member 33 is disposed in a state in which the mounting groove 44 of the adjusting rod 34 faces the neck surface side, as shown in FIG. 3. In lieu thereof, it is also possible to dispose the second neck member 33 in a flipped state (the state in which the rod-mounting groove 44 faces the neck reverse surface side).

The present embodiment is one in which the present invention has been applied to a Les Paul-type electric guitar, but the present invention can naturally be similarly applied to other types of electric guitars.

The invention claimed is:

1. A string tension support structure of an electric guitar or an electric bass comprising a body, a neck, and a plurality of strings spanning from a nut attached to a distal end part of the neck to a bridge attached to a surface of the body in a state of tension, wherein the neck is provided with a first wooden neck member secured to the body, a fingerboard attached to a surface of the first neck member, and a second metal neck member partially secured in a plurality of locations to both the first neck member and the body;

the second neck member is provided with a distal-end-side portion disposed inside the first neck member, and a rear-end-side portion disposed inside the body;

a distal end of the distal-end-side portion extends to a disposed position of the nut supporting the strings at a distal end part of the neck in a neck lengthwise direction; and a rear end of the rear-end-side portion extends at least to positions at which the strings are secured to the body in the neck lengthwise direction, and wherein the distal-end-side portion of the second neck member is a planar frame provided with a plurality of longitudinal ribs extending in the neck lengthwise direction, a plurality of lateral ribs extending in a neck width direction perpendicular to the neck lengthwise direction, and a plurality of diagonal ribs extending in a direction different from the longitudinal ribs and lateral ribs;

the longitudinal ribs, the lateral ribs, and the diagonal ribs are disposed in a bilaterally symmetric manner with respect to the neck width direction; and openings surrounded by the longitudinal ribs, the lateral ribs, and the diagonal ribs have mutually different shapes in the neck lengthwise direction.

2. The string tension support structure according to claim 1, wherein the plurality of locations where the second neck member is secured to the first neck member and the body are disposed at a different pitch in the neck lengthwise direction.

3. The string tension support structure according to claim 1, wherein a mounting groove in which the second neck member is mounted is formed on a surface of the first neck member;

protrusion parts having a shape profile that corresponds to the openings protrude from a bottom surface of the mounting groove;

distal ends of the protrusion parts are exposed from the opening parts; and the fingerboard is affixed to the distal end surfaces of the protrusion parts.

4. The string tension support structure according to claim 1 wherein rod-shaped neck reinforcement member disposed inside a neck body portion of the neck, the neck body portion protruding from the body, is provided in order to inhibit or correct deformation generated in the neck body portion; and the neck reinforcement member spans between a distal end part and a rear end part in the neck lengthwise direction in the distal-end-side portion of the second neck member in a tensioned state.

5. The string tension support structure according to claim 4, wherein the distal-end-side portion of the second neck member is provided with a groove extending in the neck lengthwise direction in the distal-end-side portion in a center position of the neck width direction; and the neck reinforcement member is mounted in the groove.

* * * * *